US008726583B2

(12) United States Patent
Verdecia et al.

(10) Patent No.: US 8,726,583 B2
(45) Date of Patent: May 20, 2014

(54) MODULAR DWELLINGS

(75) Inventors: Sean Carlos Verdecia, Tampa, FL (US); Jason Michael Ross, Tallahassee, FL (US)

(73) Assignee: University of South Florida (A Flordia Non-Profit Corporation), Tampa, FL (US)

( * ) Notice: Subject to any disclaimer, the term of this patent is extended or adjusted under 35 U.S.C. 154(b) by 0 days.

(21) Appl. No.: 13/640,425

(22) PCT Filed: Apr. 13, 2011

(86) PCT No.: PCT/US2011/032228
§ 371 (c)(1),
(2), (4) Date: Oct. 10, 2012

(87) PCT Pub. No.: WO2011/130351
PCT Pub. Date: Oct. 20, 2011

(65) Prior Publication Data

US 2013/0031851 A1 Feb. 7, 2013

Related U.S. Application Data

(60) Provisional application No. 61/323,634, filed on Apr. 13, 2010.

(51) Int. Cl.
*E04B 2/82* (2006.01)

(52) U.S. Cl.
USPC ..... 52/126.1; 52/220.1

(58) Field of Classification Search
USPC ..... 52/126.1, 655.1, 656.1, 653.2, 220.1, 52/282.2; 403/171
See application file for complete search history.

(56) References Cited

U.S. PATENT DOCUMENTS

| | | | | |
|---|---|---|---|---|
| 3,089,716 | A * | 5/1963 | Berkowitz | 403/13 |
| 3,386,590 | A * | 6/1968 | Gretz | 211/189 |
| 3,711,133 | A * | 1/1973 | Werner | 403/172 |
| 4,323,319 | A | 4/1982 | Adams | |
| 4,348,129 | A * | 9/1982 | Conforti | 403/218 |
| 4,691,970 | A * | 9/1987 | Neri | 312/265.5 |
| 4,844,648 | A * | 7/1989 | Fentiman | 403/171 |

(Continued)

FOREIGN PATENT DOCUMENTS

| | | |
|---|---|---|
| JP | 2009144848 | 7/2009 |
| KR | 200200356 | 10/2000 |

OTHER PUBLICATIONS

International Search Report and Written Opinion, mailed Dec. 29, 2011.

*Primary Examiner* — Basil Katcheves
(74) *Attorney, Agent, or Firm* — Thomas | Horstemeyer, LLP

(57) ABSTRACT

In one embodiment, a modular dwelling comprises a beam connector comprising a body and multiple arms that extend out from the body, structural beams comprising outer sides that define elongated channels that extend along a length of the beams, each beam being connected to an arm of the beam connector, a locking means that secure the structural beams to their associated beam connector arms, and a structural panel that comprises multiple edges, at least one edge of the panel being received by a channel of at least one structural beam.

16 Claims, 10 Drawing Sheets

(56) References Cited

U.S. PATENT DOCUMENTS 5,469,681 A * 11/1995 Wu ..... 52/656.9
5,471,804 A * 12/1995 Winter, IV ..... 52/220.1
5,590,974 A * 1/1997 Yang ..... 403/327
5,803,782 A * 9/1998 Selton ..... 446/126
5,890,341 A 4/1999 Bridges
6,082,070 A * 7/2000 Jen ..... 52/650.3
6,412,243 B1 * 7/2002 Sutelan ..... 52/309.7
6,516,955 B1 * 2/2003 Dudhwala et al. ..... 211/26

* cited by examiner

MODULAR DWELLINGS

CROSS-REFERENCE TO RELATED APPLICATION

This application is the 35 U.S.C. §371 national stage of, and claims priority to and the benefit of, PCT application PCT/US2011/032228, filed Apr. 13, 2011, which claims priority to and the benefit of U.S. Provisional Application No. 61/323,634, filed on Apr. 13, 2010, herein incorporated by reference in its entirety.

BACKGROUND

In certain circumstances, temporary dwellings are needed that can be quickly deployed to provide shelter to those who need it. For example, such dwellings are often needed in disaster areas in which permanent dwellings have been damaged or destroyed by acts of nature, such as hurricanes, earthquakes, and tsunamis.

Temporary dwellings can take various forms, including tents, prefabricated trailers, and conventional buildings. Unfortunately, each of these dwellings has one or more drawbacks. Tents, for example, may not provide adequate shelter or security to the inhabitant. Although prefabricated trailers provide a significant improvement over tents, they are large and bulky and therefore are difficult to transport, especially to areas that have been devastated by a natural disaster. While conventional buildings can be constructed at or near a disaster area, skilled laborers are required to construct them and the construction process can be expensive and take a long time to complete.

In view of the above drawbacks of current solutions to the need for temporary dwellings, it can be appreciated that it would be desirable to have a temporary dwelling that provides adequate shelter and security to the occupants, and that can be quickly and easily assembled without the need for skilled laborers.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, current temporary dwellings, such as those often used in disaster areas, have various drawbacks. Disclosed herein is a modular dwelling that avoids one or more of those drawbacks. The modular dwelling can be used as a temporary dwelling, or even a permanent or semi-permanent dwelling. Unlike known dwellings, the disclosed modular dwelling provides good shelter and security, and can be quickly and easily assembled without the need of skilled laborers or special tools.

In the following disclosure, various embodiments are described. It is to be understood that those embodiments are mere example implementations of the inventions and that other embodiments are possible. All such other embodiments are intended to fall within the scope of this disclosure.

Figure 1:
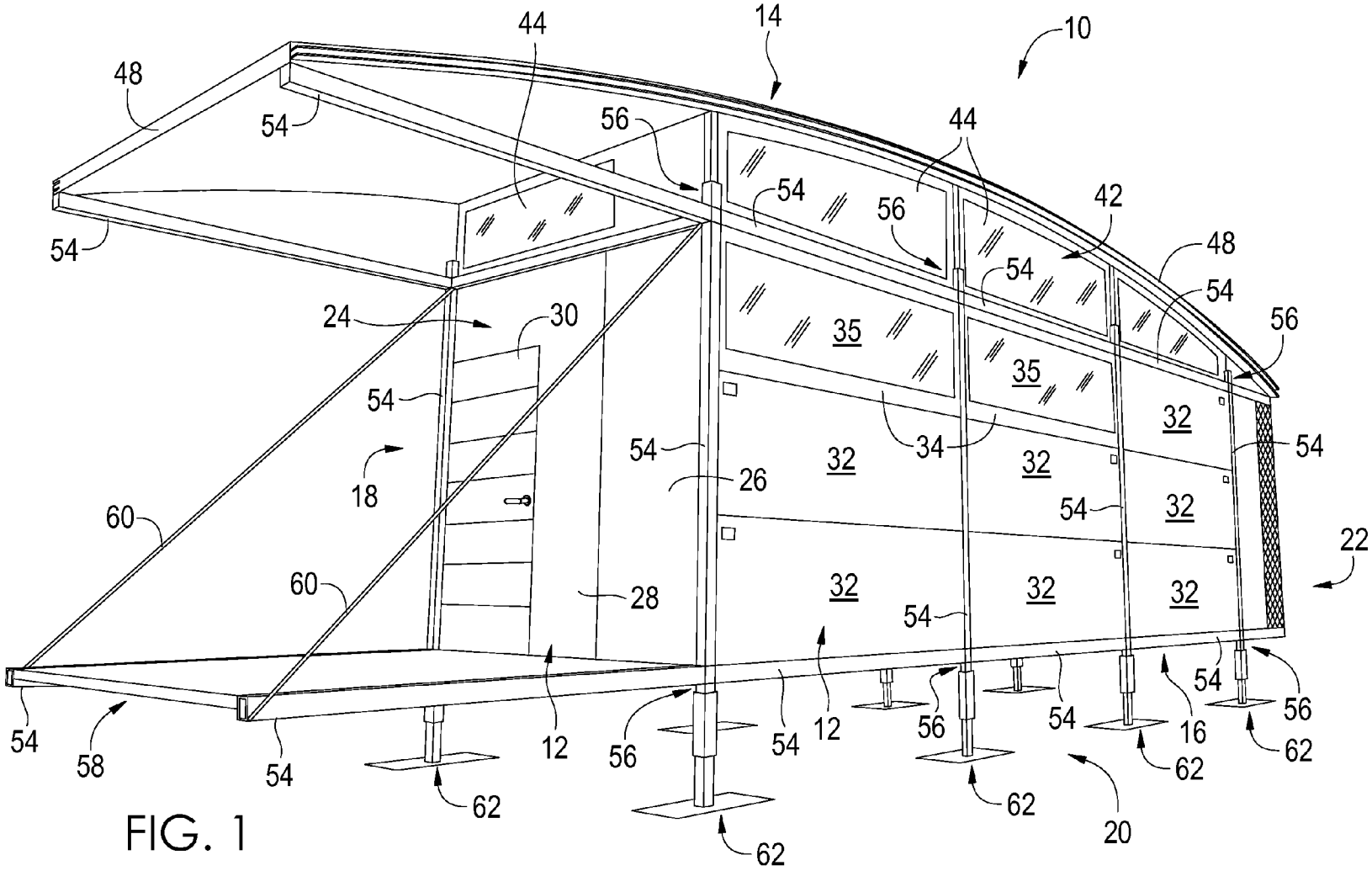
FIG. 1 is a front perspective view of an embodiment of a modular dwelling.
Figure 2:
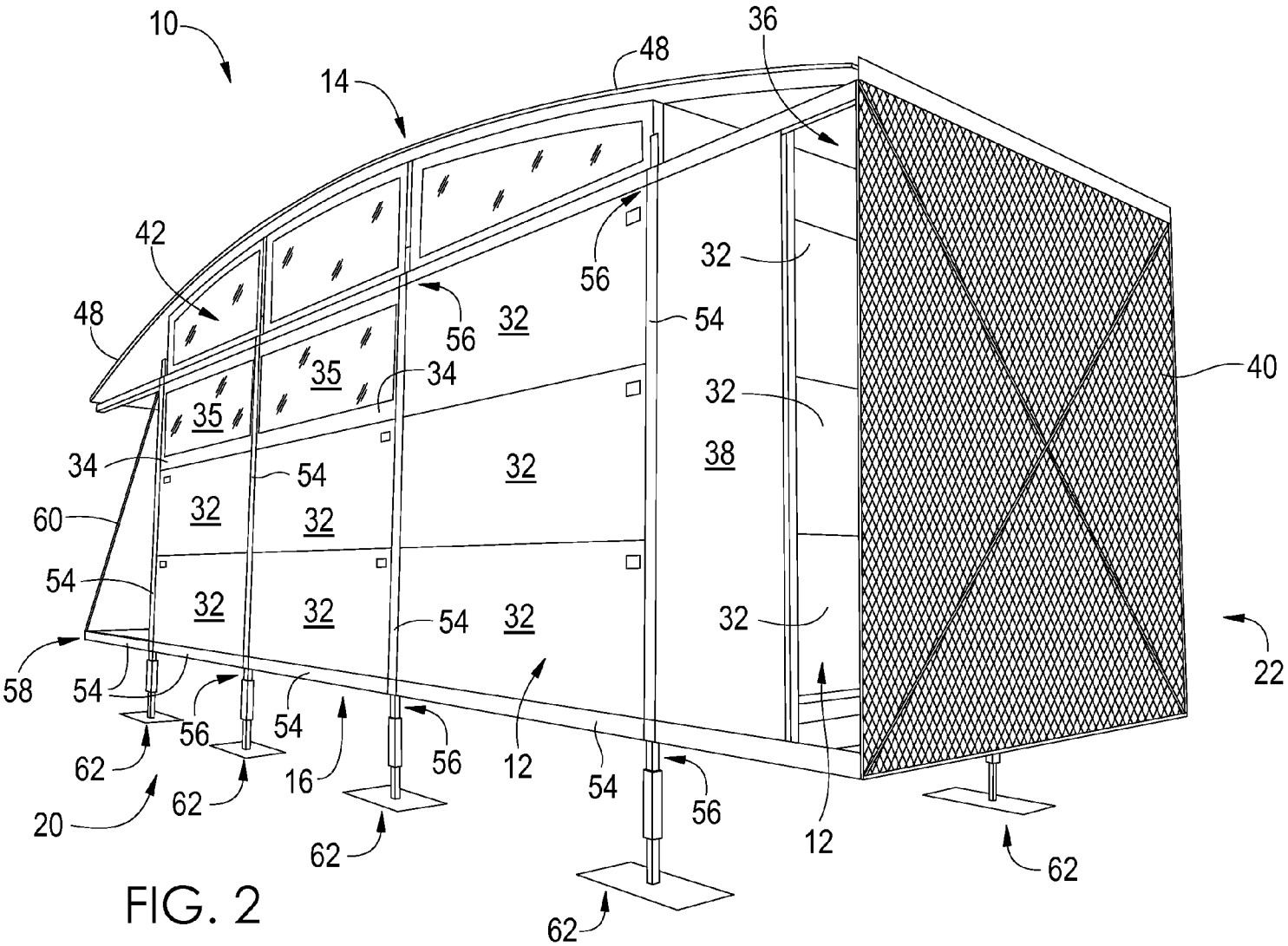
FIG. 2 is a rear perspective view of the modular dwelling of FIG. 1.
Figure 3:
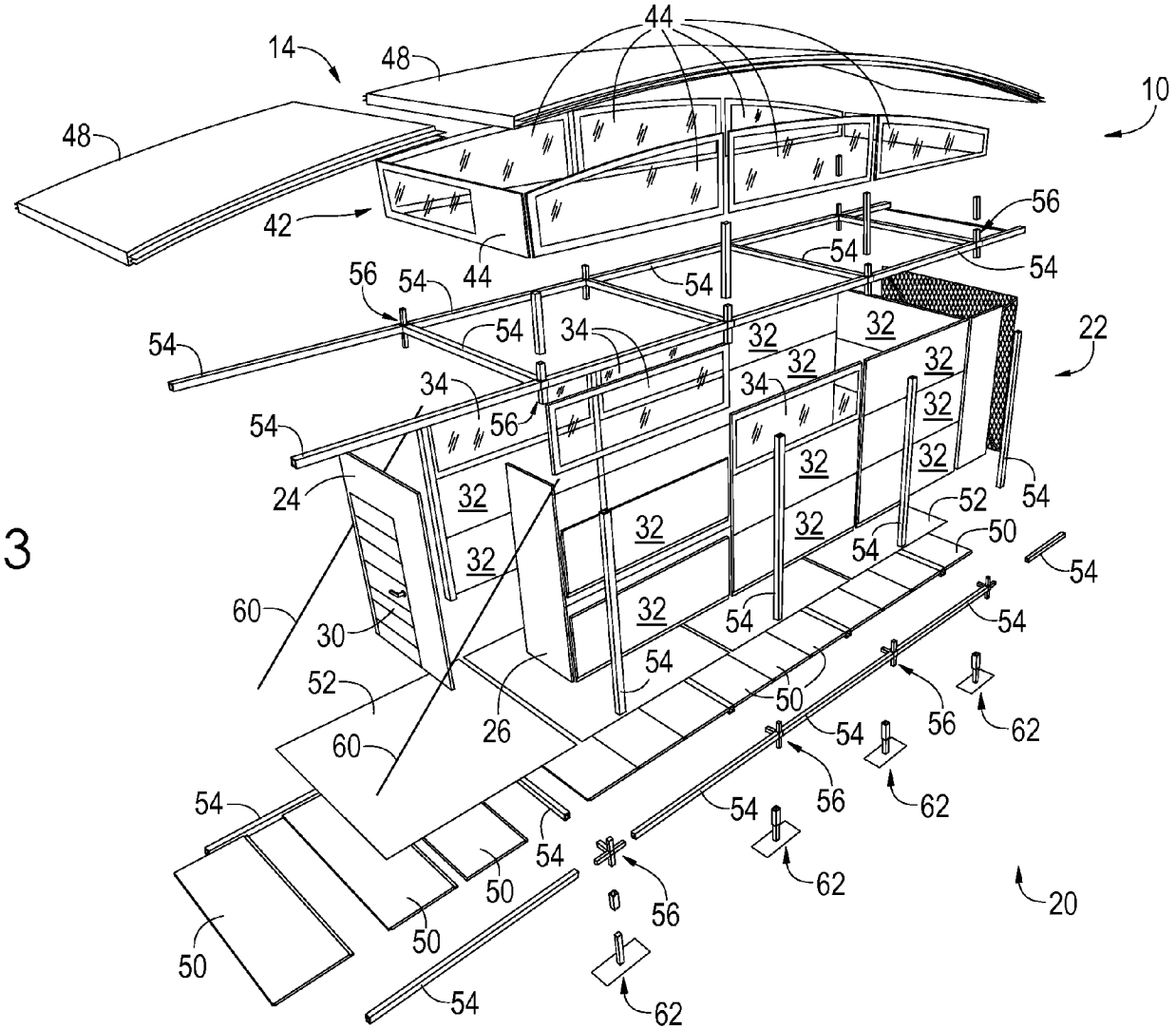
FIG. 3 is an exploded front perspective view of the modular dwelling of FIGS. 1 and 2 illustrating the individual components used to construct the dwelling.

FIGS. 1-3 illustrate an embodiment of a modular dwelling 10. More specifically, FIG. 1 illustrates the front of an assembled dwelling 10, FIG. 2 illustrates the rear of the assembled dwelling, and FIG. 3 shows the dwelling in an exploded perspective view to reveal the components that are used to form the dwelling. With particular reference to FIGS. 1 and 2, the dwelling 10 generally comprises vertical walls 12, a roof 14, and a horizontal base or floor 16 that together define an enclosed interior living space. In the illustrated embodiment, the dwelling 10 includes four walls 12 that define a front 18, lateral sides 20, and a rear 22 of the dwelling.

As is illustrated in FIGS. 1 and 3, the front 18 of the dwelling 10 is defined by a door assembly 24 and a structural panel 26. The door assembly 24 includes its own structural panel 28 and a door 30 that can be used to enter and exit the dwelling 10.

The lateral sides 20 of the dwelling 10 comprise a plurality of structural panels 32 each having the same or similar dimensions and construction. As is apparent from FIGS. 1 and 3, each panel 32 is thin and generally planar and has four orthogonal edges that together define a rectangle that is oriented so that its length direction is aligned with the horizontal direction. In the example embodiment illustrated in FIGS. 1-3, seven panels 32 are provided to form the wall 12 of the side 20 of the dwelling 10. In addition to the structural panels 32, the wall 12 of the side 20 of the dwelling 10 can further include window panels 34. Like the structural panels 32, the window panels 34 also provide structural support to the wall 12. However, the window panels 34 each comprise a pane 35 of glass or another transparent or translucent material to provide natural light to the interior living space of the dwelling 10. In the illustrated embodiment, two window panels 34 are provided in the wall 12 on each side 20 of the dwelling 10.

With reference to FIG. 2, the rear 22 of the dwelling 10 includes a further wall 12 that, like the wall 12 of the lateral side 20, comprises multiple structural panels 32. In addition, however, the rear 22 of the dwelling 10 includes a utility space 36 that is partially enclosed by lateral side panels 38 and a rear perforated screen 40. The utility space 36 can be used to support electrical, plumbing, and air conditioning equipment (not shown) that can be used to service the dwelling 10.

Located above the walls 12, or forming part of those walls, is a top portion 42 of the dwelling 10, which can include window panels 44 of various shapes and sizes. Like the window panels 34, the window panels 44 can each comprise a pane of glass or another transparent or translucent material that enables natural light to enter the interior living space. The top portion 42 is capped by one or more roof panels 48. In the illustrated embodiment, the top edges of the window panels 44 along the sides 20 of the dwelling 10 and the roof panels 48 are curved. The curvature of the roof panels 48 prevents rainwater from collecting on the roof 14. In some embodiments, the roof panels 48 incorporate solar panels to generate electricity from the light of the sun. In further embodiments, the roof panels 48 can be connected to other roof panels to expand the dwelling in the lateral direction (width dimension).

Referring to FIG. 3, the floor 16 is comprised of multiple structural panels 50. The panels 50 can be similar in dimensions and construction to the structural panels 32 of the walls 12 of the dwelling 10. Optionally, the floor 16 can further include finished floor panels 52 that overlie the structural panels 50 to provide further support and a more finished look to the living space.

Figure 10:
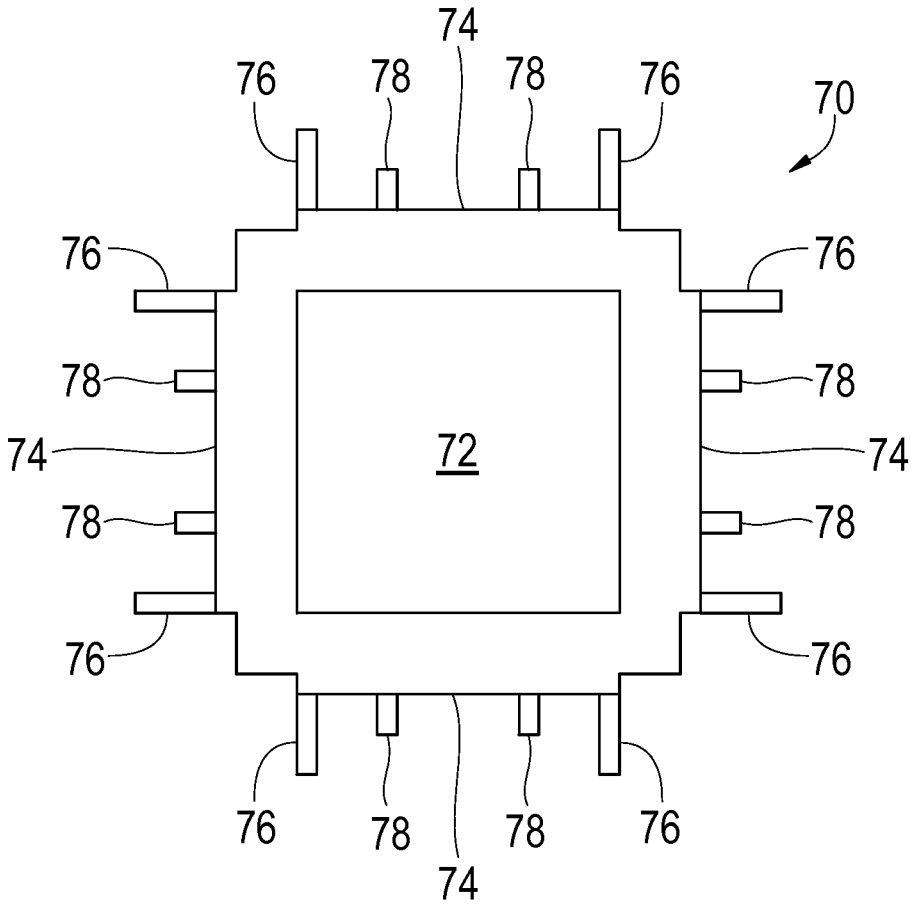
FIG. 10 is an end view of an embodiment of a structural beam that can be used to construct a modular dwelling.

As is most clearly apparent in FIG. 3, each of the walls 12 and the floor 16 incorporates multiple structural beams 54. Accordingly, the same beams 54 are used both in a generally vertical orientation (e.g., for the walls 12) and in a generally horizontal orientation (e.g., for the walls 12 and the floor 16) and are substantially identical in dimensions and construction. As described below, this universality of the dwelling components simplifies dwelling assembly. Example embodiments for the configuration of the beams 54 are described below in relation to FIGS. 4 and 10. Regardless of the particular nature of the beams 54, the beams support their associated structural panels 32, 50 and help define the frame of the dwelling 10.

As is also apparent in FIG. 3, the structural beams 54 connect to each other with beam connectors 56 that receive the ends of the beams. Example embodiments for the connectors 56 are described below in relation to FIGS. 4 and 11. Regardless of the particular configuration of the connectors 56, the connectors link the beams 54 and maintain their orientation and therefore also help define the frame of the dwelling 10.

With reference again to FIG. 1, the dwelling 10 can further include a porch or landing 58 that extends from the front 18 of the dwelling 10. As is apparent from FIG. 3, the landing 58 can also be constructed of structural panels 50, finished panels 52, and structural beams 54 just as the floor 16. Indeed, the landing 58 can be thought of as an extension of the floor 16. In some embodiments, the landing 58 is at least partially supported by cables 60 that extend from a front edge of the landing to the front 18 of the dwelling 10 adjacent the top portion 42. Notably, the roof 14 can also extend outward from the front 18 of the dwelling 10 such that it extends over the landing 58.

As is illustrated in each of FIGS. 1-3, the dwelling 10 further includes support legs 62 that support the dwelling and provide space between the floor 16 and the ground surface. An example embodiment of the support legs 62 is described below in relation to FIG. 6. As discussed in reference to FIG. 6, the support legs 62 can attach to the beam connectors 56 in a universal manner. In some embodiments, the legs 62 are individually adjustable in length or height so that the dwelling 10 can be maintained in a level orientation on uneven terrain.

Figure 4:
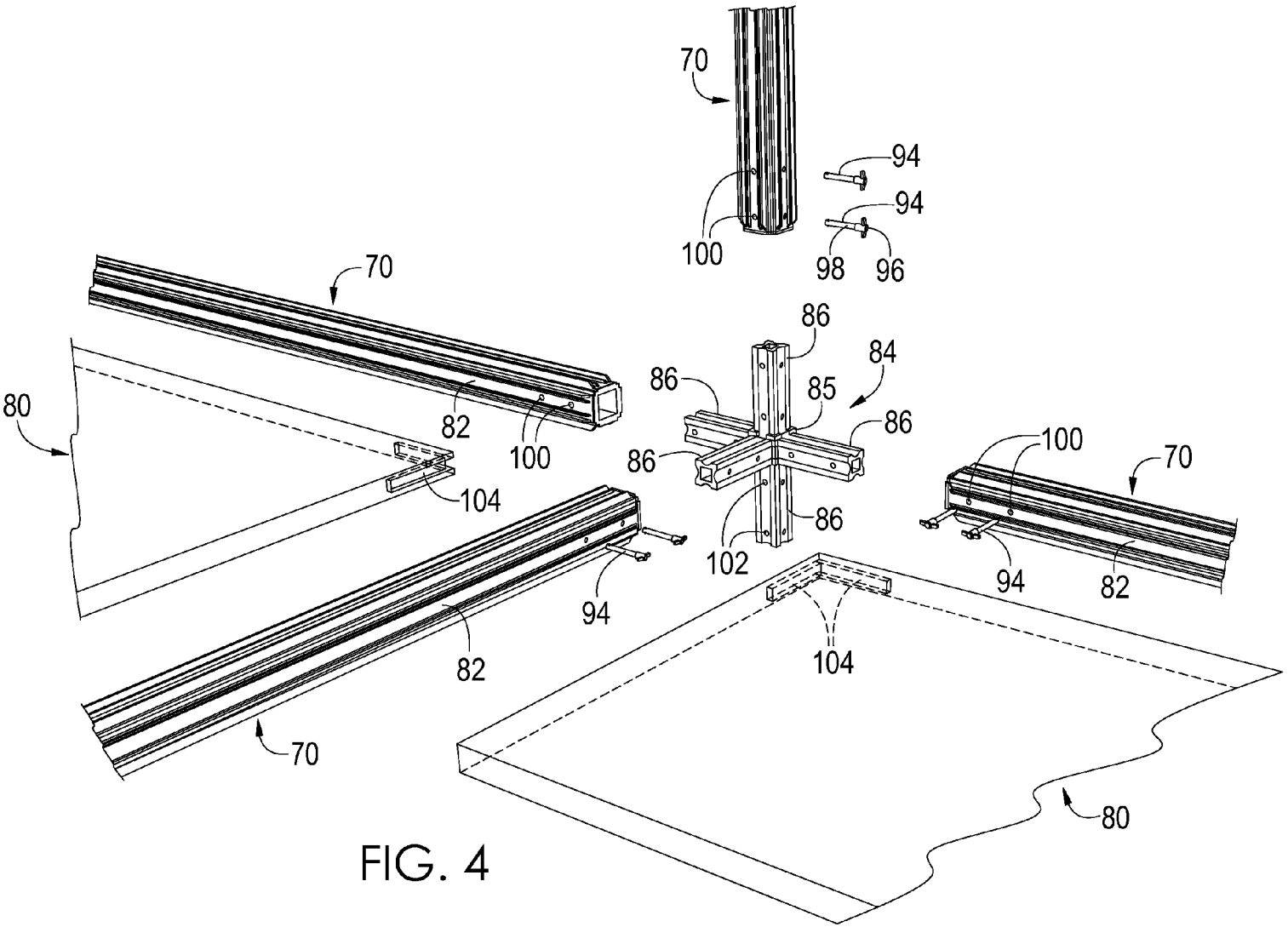
FIG. 4 is a partial perspective view of structural beams, a beam connector, and structural panels that can be used to construct a modular dwelling.

Referring next to FIG. 4, illustrated are example embodiments for structural beams, beam connectors, and structural panels that can be used to construct a modular dwelling, such as the dwelling 10 shown in FIGS. 1-3. More particularly, the illustrated structural beams, beam connectors, and structural panels can be used to construct the walls and the floor of the dwelling. FIG. 4 provides an indication of the manner in which the beams connect to the beam connectors and the manner in which the panels are supported by the beams. FIG. 4 therefore reveals the manner in which much of the modular dwelling can be assembled.

As is shown in FIG. 4, each of the structural beams 70 is elongated and hollow. In some embodiments, the beams 70 comprise extruded aluminum tubes. As is clear from FIG. 10, which is an end view of one of the beams 70, the beams can have a generally rectangular (e.g., square) cross-section so as to define a rectangular (e.g., square) inner passage 72 and four generally planar outer sides 74. Extending from each outer side 74 and further extending along the length of the beams 70 are outwardly extending elements. In some embodiments, each of those elements is unitarily formed with the beam 70 such that all components of the beam are constructed from the same piece of material. In the illustrated embodiment, each side 74 is provided with two outer flanges 76 and two inner ribs 78. The flanges 76 are positioned near the corners of the sides 74 and the ribs 78 are positioned between the flanges. As can be appreciated from FIG. 10, the flanges 76 are substantially longer or taller (in the direction extending outward from the sides 74) than the ribs 78. By way of example, the flanges 76 are approximately twice as tall than the ribs 78. As can also be appreciated from FIG. 10, each side 74 of the beam 70, including its outwardly extending elements, is substantially identical to simplify the assembly process.

The flanges 76 and the ribs 78 serve different purposes. The inner sides of the flanges 76 serve as support surfaces for other components of the dwelling and each pair of flanges provided on each side 74 of the beam 70 defines the lateral edges of an elongated channel that runs along the length of the beam in which those other components can be positioned and held. For instance, the pairs of flanges 76 form channels in which structural panels 80 (FIG. 4) can be positioned. As mentioned above, each of the structural beams 70 used to construct the walls and the floors of the dwelling can be identical in dimension and construction to achieve universality of components. Because of such universality, the assembler does not need to distinguish floor beams from wall beams, or vertical wall beams from horizontal wall beams, thereby greatly simplifying the assembly process.

In the example of FIG. 4, the structural panels 80 comprise floor panels that will define at least part of the floor of the dwelling. By way of example, the panels 80 are made of structural insulated panels (SIPs) that comprise a composite of multiple materials. By way of example, the panels can comprise an insulating layer of rigid polymer foam sandwiched between two layers of structural board material. The polymer foam can be, for example, expanded polystyrene foam (EPS), extruded polystyrene foam (XPS), or polyurethane foam, and the structural board material can be, for example, sheet metal (e.g., aluminum), plywood, cement, or oriented strand board (OSB). The panels 80 can be slid into channels 82 defined by the flanges 76 of adjacent structural beams 70. The ribs 78 serve to securely hold the panels 80 in place once they have been moved into the channels 82. In particular, the ribs 78 press into the edges of the panels 80 to ensure that the panels do not shift and to ensure that a tight seal is achieved. In some embodiments, the ribs 78 support weather stripping provided on the panels 80.

As described above, the beam connectors connect the structural beams of the dwelling together so that a frame can be formed that can support the structural panels of the dwelling. FIG. 4 illustrates an example of one such beam connector 84 that is adapted to connect the beams 70. In the example of FIG. 4, the beam connector 84 is designed for use along a side wall of the dwelling. It is noted, however, that alternative beam connectors may be used for other parts of the dwelling. For example, a different beam connector may be used at a corner at the front or rear of the dwelling. Regardless of its location in the dwelling, each beam connector comprises a central body 85 from which orthogonally extend multiple arms 86. The beam connector 84 of FIG. 4 is provided with five such arms 86, each extending outward in a different orthogonal direction. More specifically, there is one arm 86 extending vertically upward, one arm extending vertically downward, two arms extending horizontally in opposite directions along what would be the side wall of the dwelling, and one arm extending horizontally along what would be the floor of the dwelling. In some embodiments, the body 85 of the beam connector 84 and its arms 86 are unitarily formed from the same piece of material (e.g., aluminum).

Figure 11:
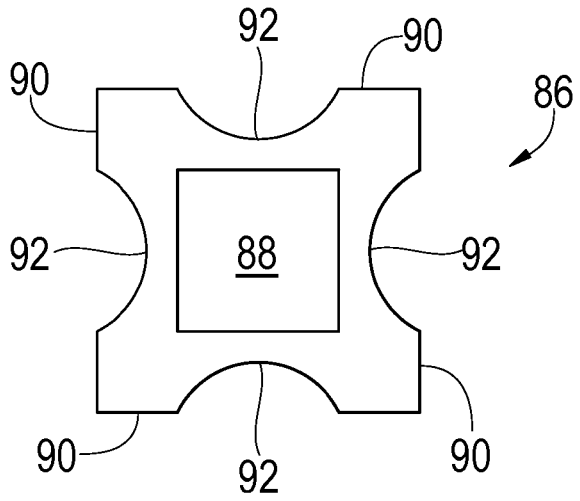
FIG. 11 is an end view of an embodiment of an arm of a beam connector that can be used to construct a modular dwelling.

FIG. 11 illustrates an end view of one of the arms 86 of the beam connector 84. As with the structural beams 70, the arm 86 can have a generally rectangular (e.g., square) cross-section so as to define a rectangular (e.g., square) inner passage 88 and four generally planar outer sides 90. The body 85 of the beam connector 84 can have an inner void so as to likewise be hollow such that each passage 88 of each arm 86 is linked with and in open communication with the passages of the other arms. Extending along each arm side 90 along its length is a curved (e.g., semi-circular) groove 92. The outer dimensions of the arm 86 are just smaller than the dimensions of the inner passage 72 of the beams 70 so that each arm can be received within a beam when an end of the beam in slid over the arm.

In the example of FIG. 4, four structural beams 82 are shown aligned with four associated arms 86 of the beam connector 84. During assembly, each beam 70 can be passed over its associated arm 86 to form part of the frame of the dwelling. Specifically, the beams 70 can be slid over the arms 86 of the connector 84 so that the arms are received within the inner passages 72 of the beams. The beams can then be secured in place on the connector arms with quick-release locking pins 94. FIG. 4 illustrates six such locking pins 94. Each pin 94 comprises a head 96 and a shaft 98 that extends out from the head. Each pin 94 is further provided with a detent at the distal tip of the shaft 98 that can be retracted when a button on the head 96 of the pin is depressed. To secure a beam 70 to the connector 84, pins 94 can be passed through holes 100 provided through the beam and aligned holes 102 provided through the arm 86 of the connector 84 so that the beam and the arm are locked together. When the pin 94 is fully inserted through the beam 70 and the arm 86, the distal tip and its detent will extend out from the opposite side of the beam. If desired, the pin 94 can be removed be depressing the button on the head 96 to retract the detent and pulling the pin out from the beam 70 and the arm 86. Therefore, the locking means used to secure the beam 70 to its associated connector arm 86 is easily reversible. This feature is useful in situations in which the dwelling is to be disassembled and reassembled at a later time.

After the structural beams 82 have been secured to the beam connector 84, the structural panels 80 can be slid into place within the channels 82 of the beams. As described above, the structural panels in the example of FIG. 4 are floor panels. Regardless, the manner of assembly is the same whether it is the floor or a wall that is being assembled. As is further shown in FIG. 4, the structural panels 80 can each comprise notches 104 that are formed along the edges of the panels near their corners. Specifically, each notch 104 can comprise an elongated groove extending from the corner of the panel 80 but not extending to the top or bottom surfaces of the panel so as to be completely contained within the edges of the panel. Such notches 104 provide space for the heads 96 and the distal tips of the locking pins 94 after they have been passed through the beams 70 and their associated connector arms 86. Notably, once the panels 80 are in place, they cover the pins 94 such that the dwelling can only be disassembled by starting from the last components that were assembled (e.g., the roof). This feature adds security and prevents unauthorized persons from improperly disassembling the dwelling.

The assembly scheme described above in relation to FIG. 4 is significant because of its great simplicity. All that the assembler must do to assemble a wall or a floor is pass light-weight structural beams over the arms of a light-weight beam connector, secure the beams in place using simple locking pins, and slide light-weight panels into place on the beams. In light of this, no tools or construction skill are needed. Therefore, with very little instruction, an unskilled person can assemble the dwelling without the assistance of skilled professionals. For instance, a typical family that has been displaced from their home by a disaster can assemble the dwelling on their own, if need be. Because of the universality of the beams, connectors, and panels, the assembly scheme is substantially the same for all aspects of the dwelling, further simplifying assembly. Accordingly, assembly can be completely quickly and easily by nearly anyone.

Figure 5:
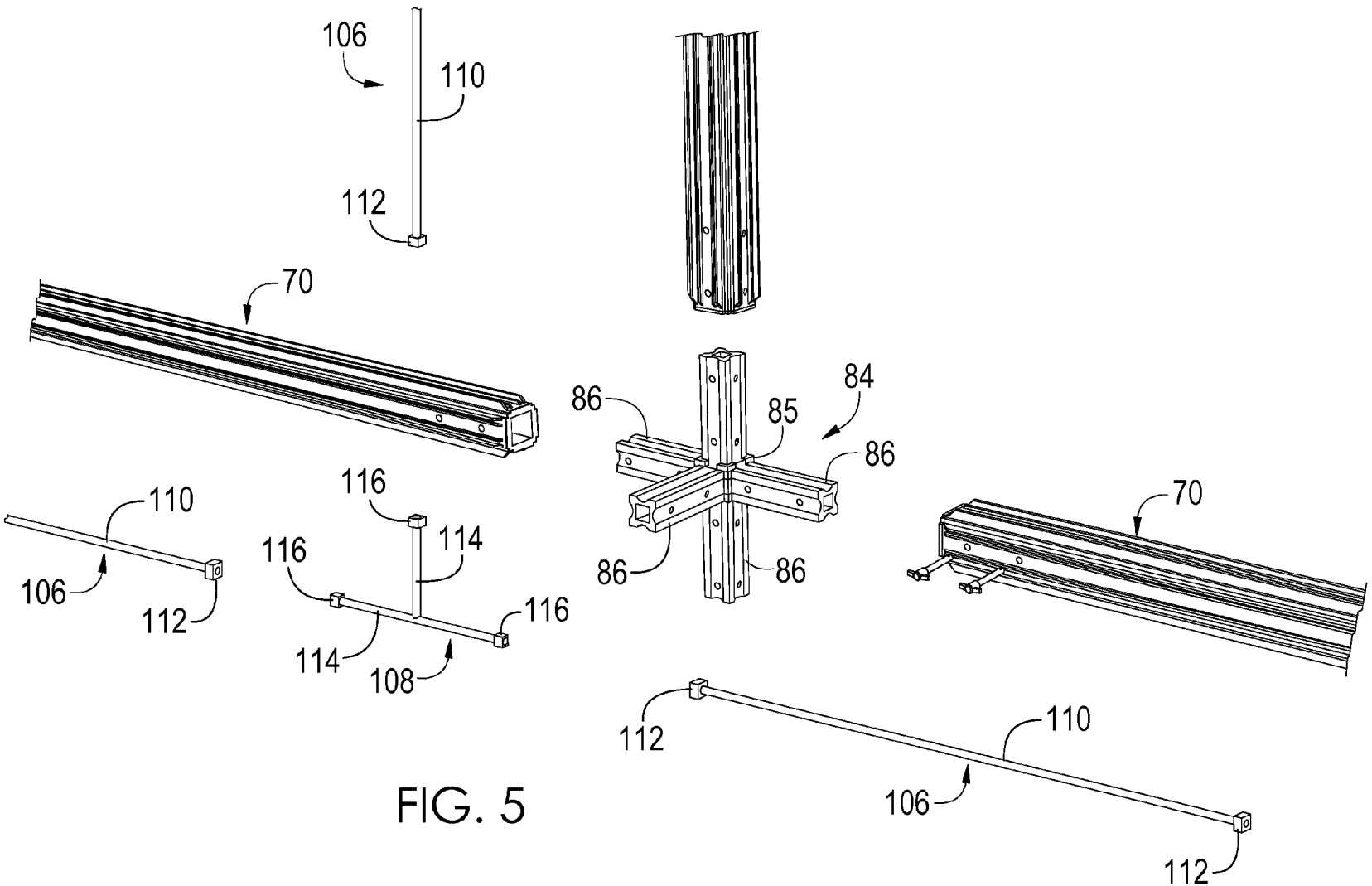
FIG. 5 is a partial perspective view of structural beams and a beam connector that can be used to construct a modular dwelling, as well as electrical conduits that can provided within the beams and the connector.

Turning to FIG. 5, illustrated are structural beams 70 and a beam connector 84 similar to those described above in relation to FIG. 4. However, FIG. 5 also illustrates electrical conduits 106 and 108 that can be provided within the structural beams 70 and the beam connector 84, respectively. In some embodiments, the conduits 106, 108 are installed within the beams 70 and the beam connectors 84 during the manufacturing process such that the beams and beam connectors come prefabricated with the conduits inside them. In some embodiments, the conduits 106 for the beams 70 each comprise an elongated tube 110 that houses one or more insulated electrical conductors (not shown) that extend along the length of the tube. Provided at each end of the tube is an electrical connector 112 that is adapted to mate with an associated electrical connector of the beam connector 84. In some embodiments, the electrical connector 112 is magnetic to ensure positive coupling with its mating electrical connector. In further embodiments, the electrical connector is spring loaded to an initially extended position to further ensure positive coupling.

The conduit 108 of the beam connector 84 is similar in construction to the conduit 106. The conduit 108, however, has multiple tubes 114 for multiple arms 86 of the connector 84 and therefore has multiple electrical connectors 116, which are each adapted to mate with an associated electrical connector of a structural beam 70. The electrical connectors 116 can also be magnetic and/or spring loaded, if desired, to facilitate positive coupling with the electrical connectors of the beams 70.

When the structural beams 70 and the beam connectors 84 are prefabricated to include integral electrical conduits and conductors as described in relation to FIG. 5, physical coupling between the beams and the connectors simultaneously results in electrical coupling between the electrical conductors within the beams and connectors. In some embodiments, this electrical coupling scheme can be used to provide electricity to substantially every structural beam 70 of the dwelling so that electrical outlets can be provided on substantially any desired beam of the dwelling. Significantly, this functionality is facilitated without any special knowledge of or skill with electrical systems and results automatically from assembly of the dwelling.

Figure 6:
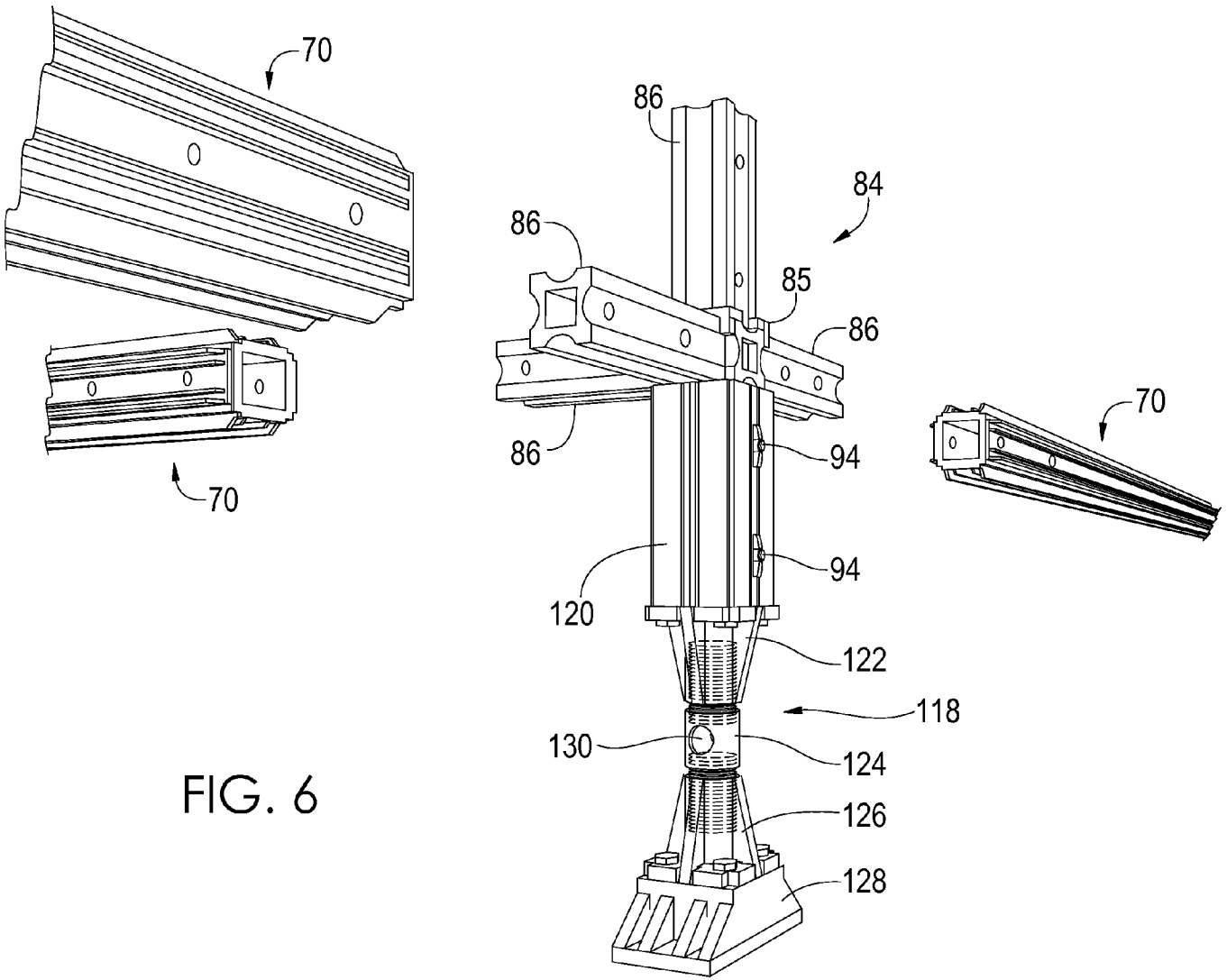
FIG. 6 is a partial perspective view of structural beams and a beam connector that can be used to construct a modular dwelling, as well as an adjustable support leg that can be used to support the modular dwelling.

With reference next to FIG. 6, illustrated is an embodiment for a support leg 118 that can be used to support a dwelling up off of the ground. As indicated in FIG. 6, the support leg 118 comprises a relatively short hollow tube member 120 that is adapted to pass over an arm 86 of a beam connector 84, for example located along a lateral side of the dwelling. In similar manner to that described above, the tube member 120 can be secured to the arm 86 using locking pins 94 that pass through the member and the arm. Extending downward from the bottom end of the tube member 120 is a first or top bracket 122 that receives a first or top threaded end of an adjustment bolt 124. A second or bottom threaded end of the bolt 124 is received by a second or bottom bracket 126, which is mounted to a foot 128. A hole 130 is provided through the bolt 124 to enable the passage of a rod or pipe (not shown) that can be used to turn the bolt.

The above-described construction enables adjustment of the length or height of the support leg 118. By rotating the bolt 124, the foot 128 can be extended or retracted relative to the dwelling to account for the topography of the ground on which the dwelling is to be assembled. Therefore, a level dwelling can be achieved by simply twisting the bolts 130 of the support legs 118 one direction or the other as is necessary. As with other aspects of the assembly process described above, this can be achieved by persons without special tools or skills.

Figure 7:
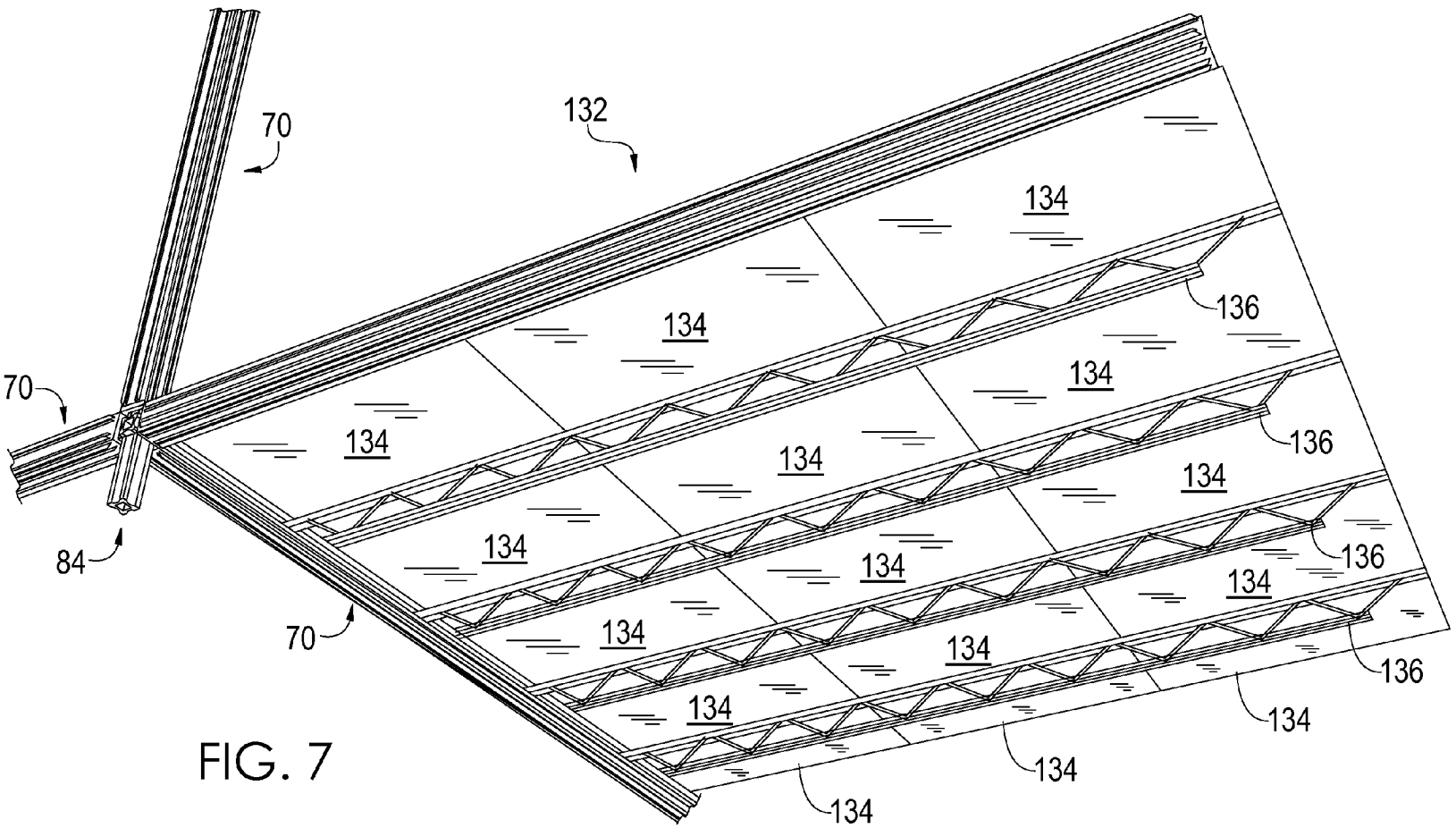
FIG. 7 is a partial perspective view of the underside of an embodiment of a floor that can be used in a modular dwelling.

FIG. 7 illustrates the underside of an example floor 132 of a modular dwelling. The floor 132 is formed from multiple structural beams 70 and multiple structural panels 134. The beams 70 and panels 134 can have dimensions and constructions similar to those described above in relation to other beams and panels of the dwelling. In alternative embodiments, however, the panels 134 can be slightly thinner to provide space for floor joists 136 that are provided along regular intervals underneath the panels. In such a case, the ends of the floor joists 136 can be placed on a lower flange 76 (see FIG. 10) within the channel of an associated structural beam 70 and the panels 134 adjacent the beam can likewise be placed within the channel (on top of the supporting joists).

Figure 8:
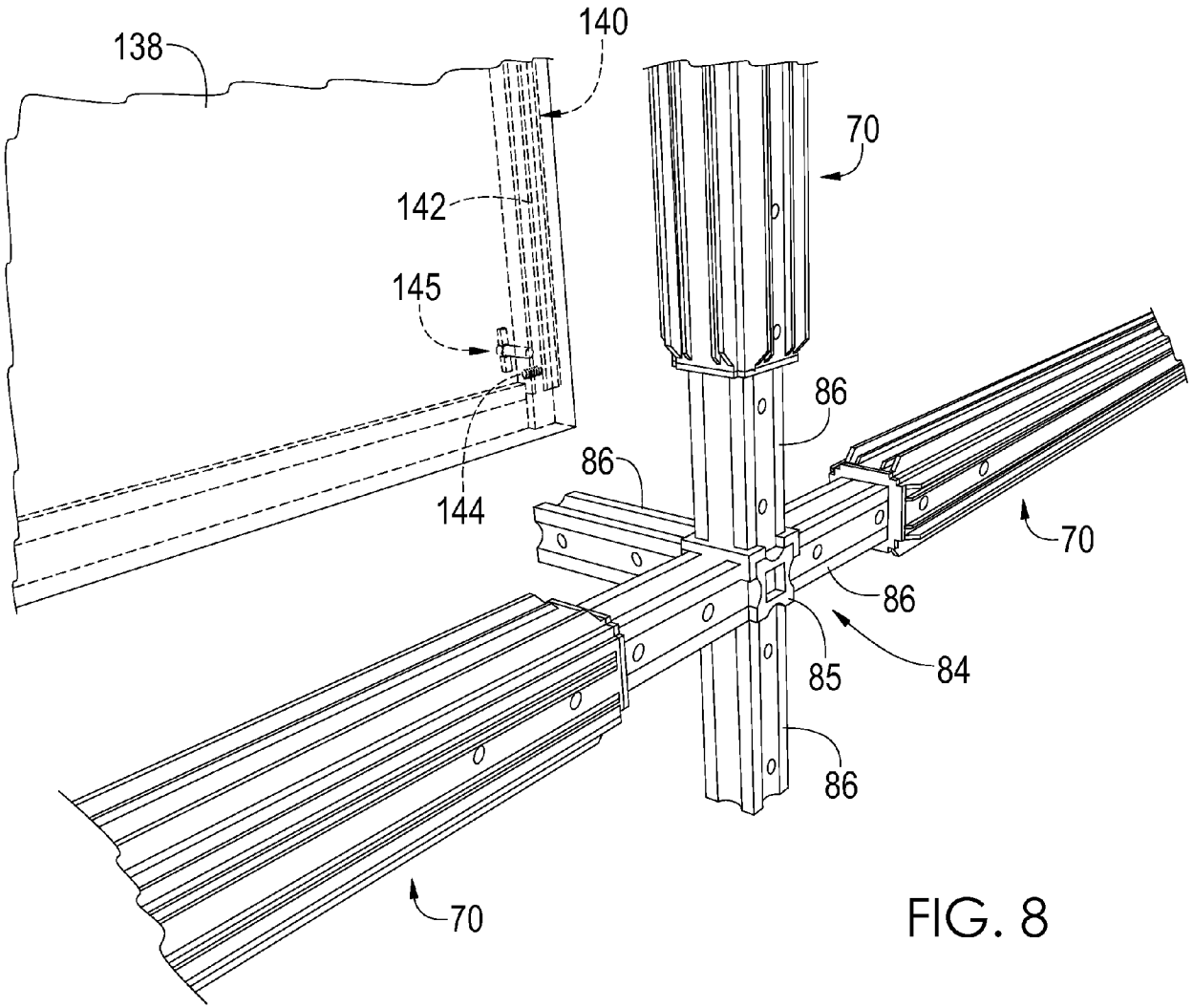
FIG. 8 is a partial perspective view of structural beams, a beam connector, and a structural panel that can be used to construct a modular dwelling, the panel including integral weather stripping.

With reference next to FIG. 8, illustrated are structural beams 70, a beam connector 84, and a structural panel 138 in the form of a wall panel. As is shown in FIG. 8, the panel 138 can be provided with weather stripping 140 along its lateral edges. Because the presence of weather stripping can make it difficult to slide the panel 138 into place along the channels of two opposed vertical beams 70, the weather stripping 140 can be placed in an initial retracted position in which it is not deployed. By way of example, the weather stripping, which can comprise a strip of resilient material, can be provided on an internal bar or strip 142 that is held in the retracted position against the force of internal springs 144 by pins 145 provided along the edges of the panel 138. In such a case, the panel 138 can be slid into place between the vertical beams 70 and the pins 145 can then be removed to allow the weather stripping 140 to deploy because of the urging of the springs 144.

Figure 9:
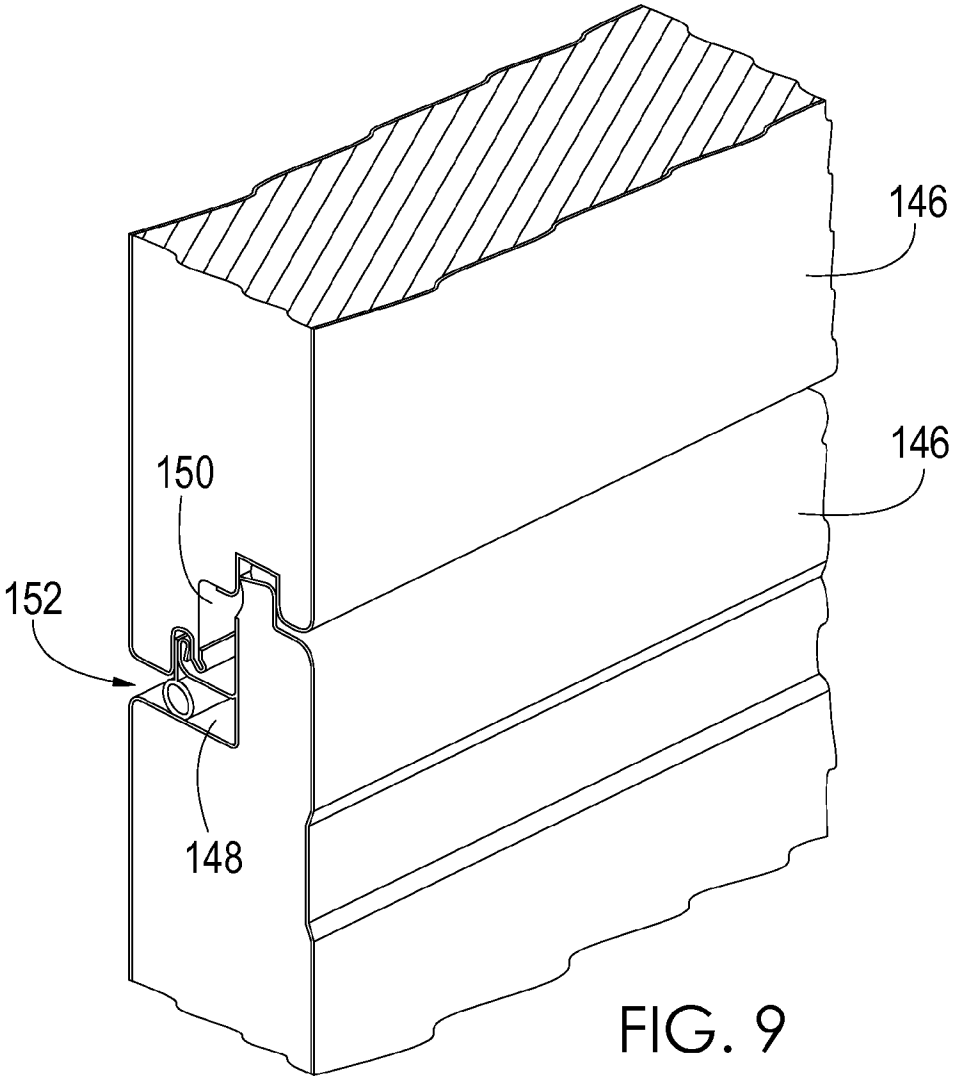
FIG. 9 is a partial perspective view of an embodiment of two structural panels that can be used to construct a modular dwelling and a seal formed between them.

FIG. 9 illustrates two wall panels 146 that can be used in a modular dwelling. The panels 146 can be of substantially identical construction. As is shown in FIG. 9, the top and bottom edges of the panels 146 have opposing notches 148 and 150, respectively, in which further weather stripping 152 can be provided. The weather stripping 152 can be associated with the top edge, the bottom edge, or both the top and bottom edges of the panels 146.

As can be appreciated from the foregoing discussion, the disclosed apparatus provides for a rapidly deploying portable dwelling comprised of interlocking components that can be assembled by unskilled laborers in a short period of time. The components of the dwelling can be shipped flat-packed in order to maximize the number of dwellings that can be deployed, thereby reducing transportation costs. The main structural components of the apparatus can be universal in construction and further can be provided with internal electrical conductors so that no independent wiring of the dwelling is needed other than providing outlets in the desired locations. In addition, the nature of the construction enables the dwelling units to be combined (e.g., in the lateral or width direction) to suit the needs of the occupants. For example, multiple dwelling units can be combined for use as classroom or other gathering space.

The invention claimed is:

1. A modular dwelling comprising:

a beam connector comprising a body and multiple arms that extend out from the body;

structural beams comprising outer sides that define elongated channels that extend along a length direction of the beams, each beam being connected to an arm of the beam connector;

locking pins that secure the structural beams to their associated beam connector arms, the locking pins comprising a non-threaded shaft and being securable without the use of a tool; and a structural panel that comprises multiple edges, at least one edge of the panel being received by a channel of at least one structural beam.

2. The dwelling of claim 1, wherein the body and arms of the beam connector are unitarily formed from a single piece of material.

3. The dwelling of claim 1, wherein the beam connector comprises at least four arms, each arm extending out from the body along a different direction.

4. The dwelling of claim 1, wherein the locking pins are quick-release locking pins that comprise a head, a shaft that extends from the head, a detent provided at a distal end of the shaft, and a button provided at the head, wherein the detent retracts when the button is depressed, and wherein the heads of the locking pins extend out into the channels of the structural beams.

5. The dwelling of claim 4, wherein the structural panel comprises notches formed along the edges at corners of the panel, the notches being adapted to provide space for the heads of the locking pins.

6. The dwelling of claim 1, wherein the structural panel is a structural insulated panel that comprises an insulating layer that is sandwiched between two layers of structural board material.

7. The dwelling of claim 1, further comprising support legs that support the dwelling above the ground, each support leg being connected to an arm of the beam connector and being individually adjustable in length so that the dwelling can be supported in a level orientation on uneven terrain.

8. The dwelling of claim 1, wherein the beam connector and the structural beams are hollow and wherein the beam connector and structural beams are provided with prefabricated internal electrical conductors that can deliver electricity.

9. The dwelling of claim 1, wherein the dwelling comprises multiple beam connectors, multiple structural beams, multiple locking means, and multiple panels, and wherein the dwelling comprises multiple walls and a floor, the walls and the floor both being constructed from the beam connectors, structural beams, locking means, and panels.

10. The dwelling of claim 1, wherein the structural beams have generally rectangular outer cross-sections defined by four outer sides and pairs of flanges that extend out from each outer side to define channels that extend along the length direction of the beams.

11. The dwelling of claim 10, wherein the structural beams further comprise ribs that extend out from each outer side between the flanges and that extend along the length direction of the beams.

12. Apparatus for constructing a dwelling, the apparatus comprising:

beam connectors comprising a body and multiple arms that extend out from the body;

structural beams comprising outer sides that define elongated channels that extend along a length of the beams, each beam having an inner passage in which an arm of the beam connector can be received;

locking pins adapted to secure the structural beams to associated beam connector arms once the arms have been received by the inner passages of the beams, the locking pins comprising a non-threaded shaft and being securable without the use of a tool; and structural panels that comprise multiple edges being adapted to fit within the channels of the structural beams.

13. The apparatus of claim 12, wherein the beam connector arms are hollow, have a generally rectangular outer cross-section, and each extend out from the body along a different orthogonal direction.

14. The apparatus of claim 12, wherein the structural beams have a generally rectangular outer cross-section defined by four outer sides and wherein pairs of flanges extend out from each outer side to define channels that extend along the length of the beams.

15. The apparatus of claim 12, wherein the locking pins are adapted to extend through holes provided through the structural beams and the beam connector arms, the locking pins each comprising a head, a shaft that extends from the head, a detent provided at a distal end of the shaft, and a button provided at the head, wherein the detent retracts when the button is depressed, and wherein the heads of the locking pins extend out into the channels of the structural beams.

16. The apparatus of claim 15, wherein the structural panels are thin and planar and each comprise four orthogonal edges that define a rectangle, the panels further comprising notches formed along the edges at corners of the panels, the notches being adapted to provide space for the heads of the locking pins.

* * * * *